United States Patent [19]

Fry

[11] Patent Number: 5,050,646

[45] Date of Patent: Sep. 24, 1991

[54] PAPERMAKERS FABRIC FOR CORRUGATION MACHINES

[75] Inventor: Ted Fry, Summerville, S.C.

[73] Assignee: Asten Group, Inc., Charleston, S.C.

[21] Appl. No.: 351,717

[22] Filed: May 15, 1989

[51] Int. Cl.[5] ..... D03D 11/00

[52] U.S. Cl. ..... 139/383 A; 139/408; 156/470

[58] Field of Search ..... 156/470; 139/383 A, 139/408, 420 A

[56] References Cited

U.S. PATENT DOCUMENTS

| | | | |
|---|---|---|---|
| 4,169,007 | 9/1979 | Pray | 156/470 X |
| 4,174,739 | 11/1979 | Rasero et al. | 139/408 X |
| 4,403,632 | 9/1983 | Romanski et al. | 139/383 A |
| 4,589,944 | 5/1986 | Torti et al. | 156/470 X |
| 4,935,082 | 6/1990 | Bennett et al. | 156/470 |

OTHER PUBLICATIONS

Scandia Corrugator Belt Analysis Sheet & Drawing (2 pgs.) 8/12/87.

Muhlen Sohn Aqua Pull Corrugator Belt Analysis Sheet & Drawing (2 pgs.) 3/3/88.

Asten J1338R Corrugator Belt Analysis Sheet (1 p.) 9/14/88.

*Primary Examiner*—Andrew M. Falik

*Attorney, Agent, or Firm*—Volpe & Koenig

[57] ABSTRACT

A corrugation machine includes a woven papermakers fabric. The fabric has at least four layers of bulky yarns interwoven with monofilament yarns. The yarns and weave patterns are selected such that the fabric has a caliper of at least 0.2 inches, a weight of between 10 to 15 ounces per square foot and a permability of at least 25 CFM.

24 Claims, 6 Drawing Sheets

PAPERMAKERS FABRIC FOR CORRUGATION MACHINES

This invention relates to papermaking and more particularly to fabrics for use in papermaking machines which make corrugated paper products.

BACKGROUND OF THE INVENTION

Generally a papermaking machine comprises a forming section, a press section and a dryer section. Papermakers fabrics transport an aqueous paper web through the machine to produce a paper product. Each of the three sections of the papermaking machine has its own unique characteristics and requirements. Accordingly, papermakers fabrics are specifically designed for each section of the papermaking machine such as forming fabrics for the forming section, wet press felts for the press section and dryer fabrics for the dryer section.

After a paper sheet is made by the conventional forming, pressing and drying operations, additional papermaking equipment can be used to manufacture corrugated material such as corrugated cardboard. As in the preliminary papermaking steps, a papermakers fabric is employed to transport the paper product during its manufacture. A corrugation machine combines separate paper sheets with an adhesive to form the corrugated paper product. As with other papermaking operations, the corrugation machine has its own unique demands on the performance of the papermakers fabric which transports the paper products therethrough.

Conventionally, corrugator belts, i.e. papermakers fabrics for corrugation machine, comprising a base fabric having one or more batts needled thereto have been utilized for the corrugation processing. Attempts have been made to utilize woven fabrics without batts as corrugation belts. For example, corrugator belts have been made having a woven fabric comprised entirely of spun polyester and polyester multifilament yarns in a three ply/three warp weave construction. Such fabrics are characterized by their relatively high weight, on the order of 20.59 oz./sq. ft., and low permeability, on the order of 4 CFM. (CFM as used herein means cubic feet per minute per square foot of fabric at ½ inch water pressure drop.)

At least one attempt has been made to provide a lightweight, high permeability fabric by constructing a 4½ ply fabric with monofilament polyester warp yarns and a combination of monofilament polyester, spun polyester and spun acrylic filling yarn layers. Although such fabric was relatively lightweight, on the order of 9.38 oz./sq. ft., and had relatively high permeability, on the order of 19 CFM, the caliper of the fabric was only 0.161 inches and the fabric had a relatively high moisture absorption characteristic.

It is desirable to provide a papermakers fabric for corrugation papermaking equipment which is relatively lightweight and permeable and which has a sufficient caliper to provide the fabric thickness desirable for processing associated with corrugation.

SUMMARY AND OBJECTS OF THE INVENTION

A corrugation machine is provided with a woven papermakers fabric. The fabric comprises a system of monofilament warp yarns interwoven with multiple layers of bulky yarns and monofilament yarns. The fabric has at least four layers of bulky yarns and at least three intermediate layers of monofilament yarns. At least two of the bulky yarn layers and one monofilament layer are disposed between two of the monofilament yarn layers. The yarns and weave patterns are selected such that the fabric has a caliper of at least 0.2 inches, a weight of between 10 to 15 ounces per square foot and a permeability of at least 25 CFM.

An object of the invention is to provide a corrugator belt having at least four layers of bulky yarns which are interwoven with monofilament yarns and, in particular, to provide at least three intermediate layers of monofilament filling yarns to provide a uniform structural network upon which top and bottom bulky yarn layers are woven.

The further object of the present invention is to provide a corrugator belt having a caliper of between 0.2 and 0.3 inches, a permeability between 25–50 CFM and weight of about 12 ounces per square foot.

Other objects and advantages of the present invention will become apparent from following description of a presently preferred embodiment.

DETAILED DESCRIPTION OF PREFERRED EMBODIMENT

Figure 1:
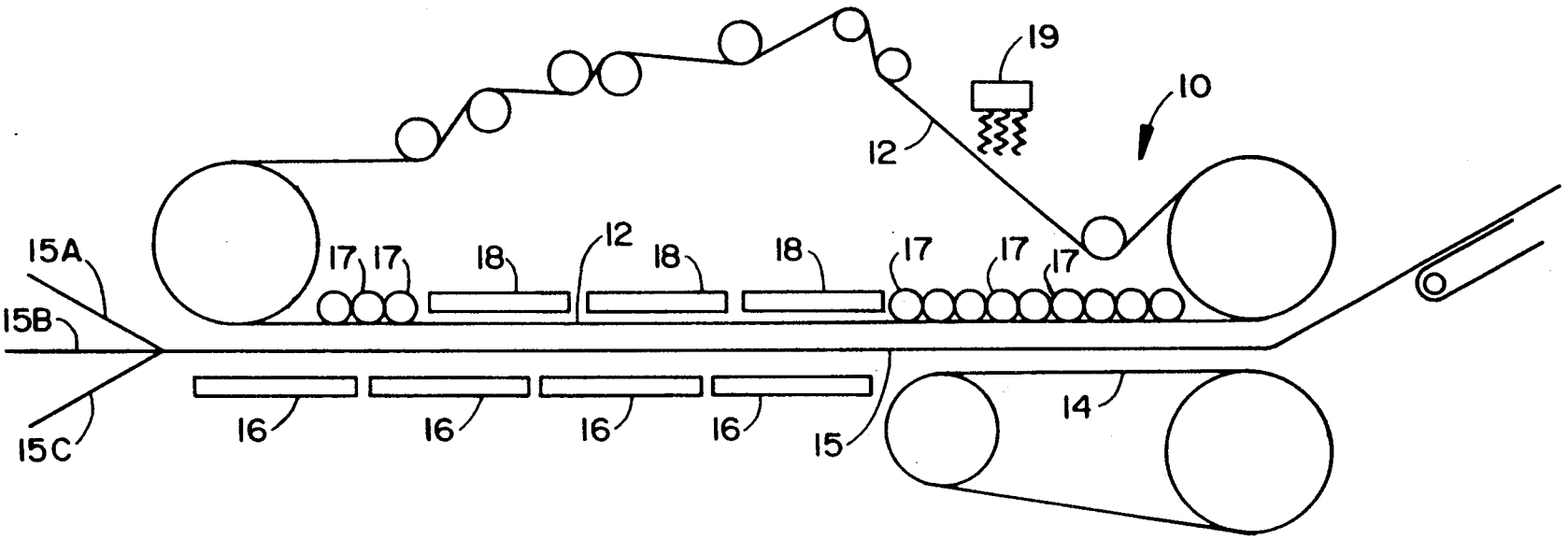
FIG. 1 is a schematic view of a portion of a corrugator machine.

Referring to FIG. 1 there is shown a portion of a corrugator machine 10 having corrugator belts 12 and 14 Which transport a corrugated paper product 15. The corrugated paper product comprises a top liner layer 15*a*, and intermediate corrugated layer 15*b*, and a bottom layer 15*c* to which an adhesive has been applied to maintain the corrugated structure of the final corrugated paper product such as corrugated cardboard. The separate layers 15*a*, 15*b*, 15*c* having adhesive applied therebetween are brought together at one end of the corrugator machine and transported by corrugator belt 12 across a series of hot plates 16 to dry and/or cure the adhesive which bonds the paper layers together.

The corrugator machine 10 includes a plurality of weighted rollers 17 and air plenums 18 which apply pressure to one surface of the fabric 12 so that the fabric transports the paper product 15 across the hot plates 16 under a selected amount of pressure. After passing over the series of hot plates 16 the corrugator belt 12 carries the paper product 15 between itself and the second corrugator belt 14 which serves to maintain the speed of the process operation and to cool the paper product 15.

After exiting the corrugator belts 12, 14, the paper product 15 is cut and/or stacked as desired for the corrugator paper product being produced. The main corrugator belt 12 may then be subject to a shower mechanism 19 which cleans the fabric 12 as it runs.

Figure 2A:
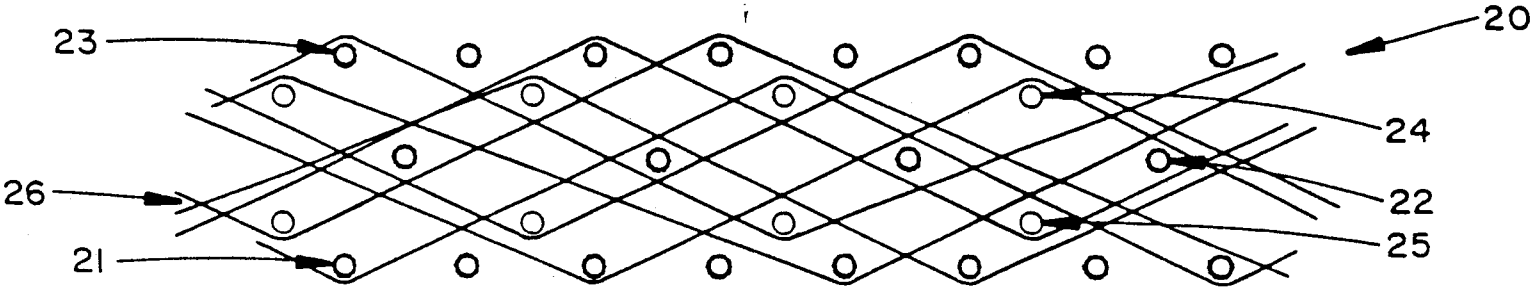
FIG. 2a PRIOR ART
FIGS. 2*a–b* are schematic diagrams of the weave structure of a prior art corrugator belt.
Figure 2B:
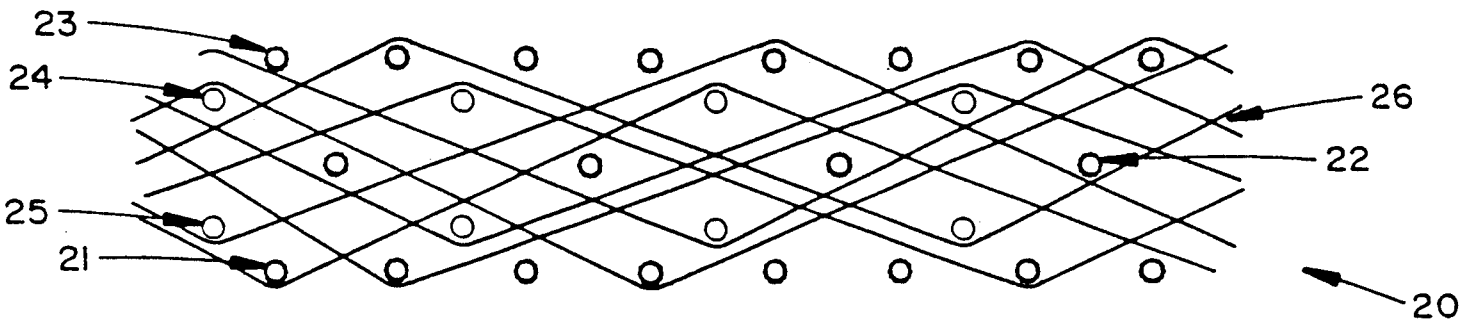
FIG. 2b PRIOR ART

With reference to FIGS. 2*a–b*, there is shown the weave structure of a prior art attempt to provide a woven papermakers fabric to serve as a corrugator belt. The fabric 20 comprises a bottom layer of spun polyester yarns 21, an intermediate and top layer spun acrylic yarns 22, 23 and two intermediate layers of monofilament yarns 24, 25. The filling yarn layers 21–25 are interwoven with a system of warp yarns 26. Analysis of one such fabric revealed warp yarns comprised of 0.020 inches polyester yarns woven 85 ends per inch and filling yarn layers totaling 56 picks per inch; the fabric having a caliper of approximately 0.161 inches, a permeability of about 19 CFM, and a weight of about 9.38 ounces per square foot. Although the sampled fabric was lightweight and had a relatively high permeability, its relatively thin caliper is potentially problematic for a corrugator belt and it exhibited a high moisture retention characteristic.

Figure 3A:
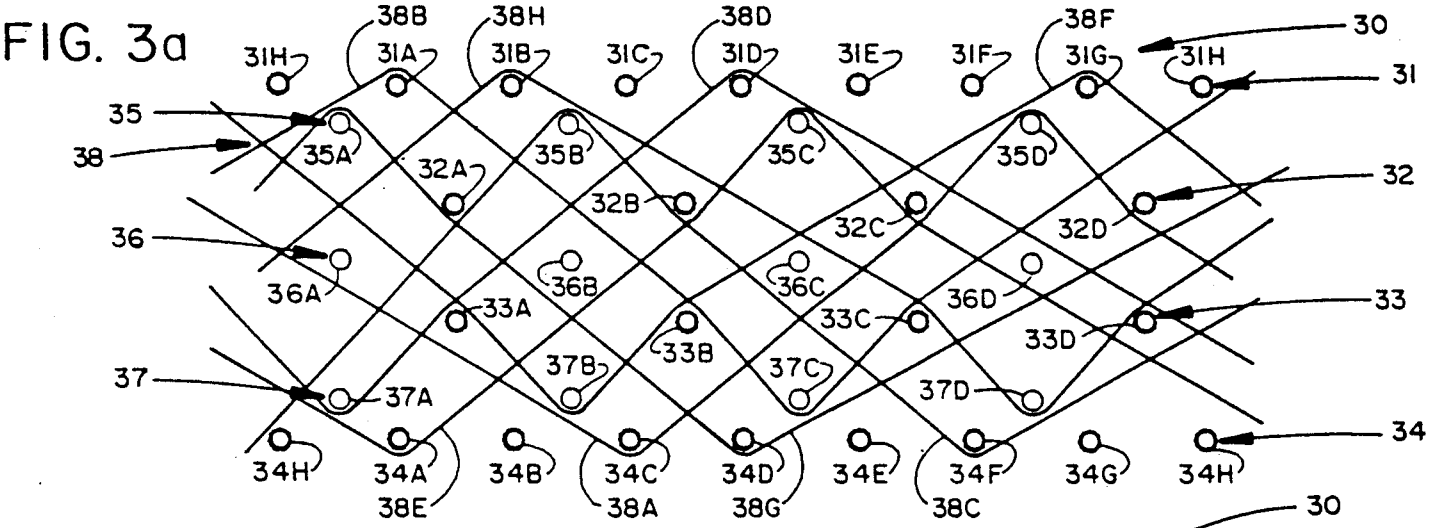
FIGS. 3*a–b* are schematic diagrams of the weave structure of a corrugator belt made in accordance with the teachings of the present invention.
Figure 3B:
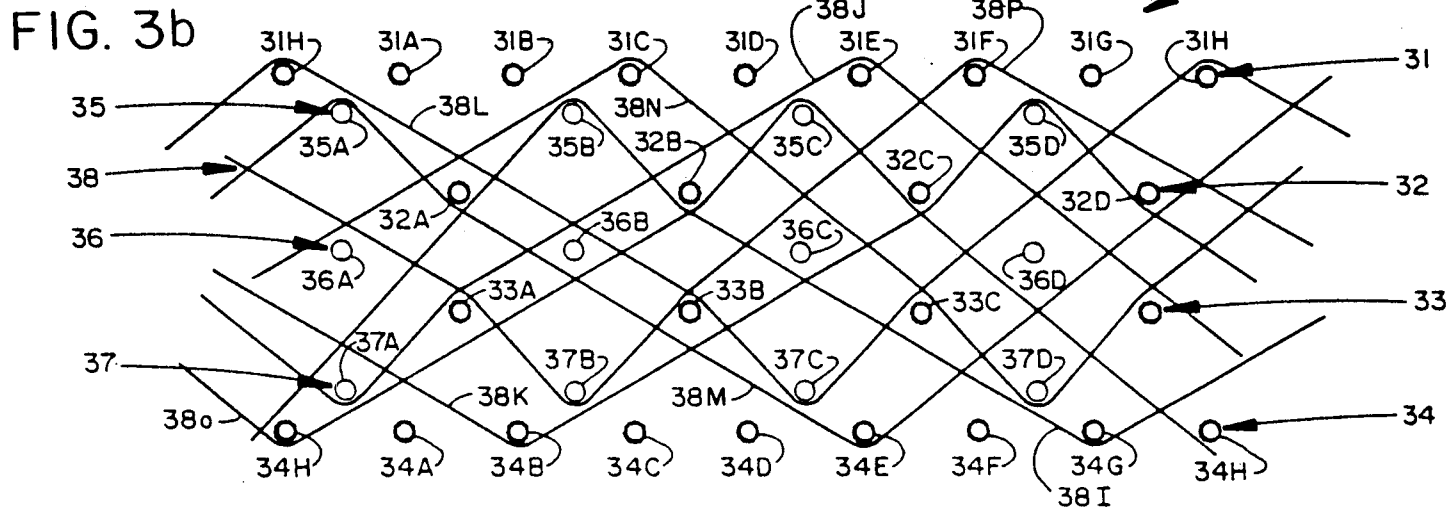

Referring to FIGS. 3*a–b* there is shown the weave diagram for a papermakers fabric 30 made in accordance with the teachings of the present invention. Unlike the prior art, the present invention comprises at least four layers of bulky yarns 31, 32, 33, 34. In addition, at least three layers 35, 36, 37 of intermediate monofilament filling yarns are provided to provide structural integrity and fabric stability to the thicker woven fabric.

The sundry filling layers 31–37 are disposed such that the fabric has a top layer 31 and a bottom layer 34 of bulky yarns. The intermediate layers of the fabric are disposed such that at least two layers 32, 33 of bulky yarns and one layer 36 of monofilament yarns are disposed between two layers 35, 37 of monofilament yarns.

The filling layers are interwoven with a system 38 of monofilament warp yarns which are preferably polyester yarns having a diameter of about 0.020 inches. The interweaving of the monofilament warp yarns 38 with the monofilament filling yarn layers 35, 36, 37 provides a stable fabric structure which maintains the position of the bulky yarns 31, 32, 33, 34 and the overall caliper of the fabric.

With respect to FIGS. 3*a–b*, there is shown a single layer 36 of monofilament yarns disposed between the interior two layers 32, 33 of bulky yarns. The system 38 of warp yarns is divided such that half of the monofilament warp yarns interweave with the top bulky yarn layer 31 and all three monofilament filling layers 35, 36, 37 and the other half of the monofilament warp yarns interweave with the bottom bulky yarn layer 34 and all three monofilament filling layers 35, 36, 37.

As shown in FIGS. 3*a–b*, the system 38 of warp yarns is a 16-harness warp system. Yarns of warp system 38 are labelled 38*a–p* to indicate the sequence of weaving of the warp yarn harness. Preferably these yarns are polyester monofilament yarns having a diameter of 0.20 inches. Top and bottom filling yarn layers 31, 34 each contain eight yarns in their repeat labelled 31*a–h*, 34*a–h* respectively; the intermediate layers of filling yarns 32, 33, 35, 36, 37, each contain four yarns in their repeat which are labelled 32*a–d*, 33*a–d*, 35*a–d*, 36*a–d*, 37*a–d*, respectively.

Warp yarns 38*a*, 38*c*, 38*e*, 38*g*, 38*i*, 38*k*, 38*m*, 38*o*, each interweave under a separate bulky yarn in the repeat of bottom layer 34 and with the interior layers of the fabric. For example, yarn 38*a* weaves between yarns 36*a* and 37*a*, between yarns 31*a* and 34*a*, under yarn 33*a*, between yarns 31*b* and 34*b*, under yarn 37*b*, under yarn 34*c*, under yarn 33*b*, between yarns 31*d* and 34*d*, between yarns 36*c* and 37*c*, between yarns 31*e* and 34*e*, between yarns 32*c* and 33*c*, between yarns 31*f* and 34*f*, over yarn 35*d*, between yarns 31*g* and 34*g*, between yarns 32*d* and 33*d*, and between yarns 31*h* and 34*h*, whereafter the pattern is repeated. In a similar fashion warp yarn 38*c* interweaves with bottom layer yarn 34*f*; warp yarn 38*m* interweaves with bottom layer yarn 34*e*, and warp yarn 38*i* interweaves with bottom layer yarn 34*g*.

Warp yarn 38*c* interweaves with bottom layer 34*f*, warp yarn 38*g* interweaves with bottom layer yarn 34*d*, warp yarn 38*k* interweaves with bottom layer yarn 34*b*, and warp yarn 38*o* interweaves with bottom layer yarn 34*h* in a similar but slightly different manner. For example, warp yarn 38*g* weaves over yarn 35*a*, between yarns 31*a* and 34*a*, between yarns 32*a* and 33*a*, between yarns 31*b* and 34*b*, between yarns 36*b* and 37*b*, between yarns 31*c* and 34*c*, under yarn 33*b*, under yarn 34*d*, under yarn 37*c*, between yarns 31*e* and 34*e*, under yarn 33*c*, between yarns 31*f* and 34*f*, between yarns 36*d* and 37*d*, between yarns 31*g* and 34*g*, between yarns 32*d* and 33*d*, between yarns 31*h* and 34*h* and thereafter repeats.

Warp yarns 38*b*, 38*d*, 38*f*, 38*h*, 38*j*, 38*l*, 38*n*, and 38*p* interweave over top layer bulky yarns 31*a*, 31*d*, 31*g*, 31*b*, 31*e*, 31*h*, 31*c*, and 31*f*, respectively, in a mirror image of the warp yarns which weave under the bottom layer 34 of bulky filling yarns as described above.

Preferably the fabric is woven flat and seamed when installed on a corrugator machine. The seam is preferably made by clinching large metallic hooks in both ends of the fabric and joining the hooks with a plastic coated solid core pintle.

Preferably polyester spun yarn made from 15 denier fibers are used for the bulky yarns. This, in cooperation with the weave, results in a relatively high permeability of the entire fabric. For example, a trial fabric was woven in accordance with the prior art weave structure depicted in FIGS. 2*a–b* having a warp system woven at 60 yarns per inch interwoven with filling yarns totaling 52.5 picks per inch. The bulky yarns were 400 yard per pound polyester spun yarns made from 6 denier fibers. That trial fabric weighted approximately 10.2 ounces per square foot, had a permeability of about 15 CFM and a caliper of about 0.185 inches.

In contrast, a test sample of a fabric was woven in accordance with the weave structure depicted in FIGS. a–b, with 400 yard per pound polyester yarns made from 15 denier fibers utilized as bulky yarns for the filling layers 31–35, 0.032 inch diameter polyester monofilament filling yarns, and 0.020 inch diameter polyester monofilament warp yarns. That sample was woven approximately 60 warp ends per inch and 65 picks per inch, resulting in a fabric having a weight of approximately 12 ounces per square foot, a permeability of approximately 27 CFM and a caliper of about 0.21 inches. Use of polyester monofilament is preferred to minimize moisture retention and maximize dimensional stability. Use of polyester bulky yarn is preferred to minimize moisture retention.

Increased fabric stability and caliper is provided by the alternative embodiments depicted in FIGS. 4*a–b*, 5*a–d*, and 6*a–b*. In each of those embodiments four monofilament filling layers are provided. The interior most two layers are substantially coplanar with the interior bulky yarn layers. Such structure provides increased caliper while maintaining the other desirable characteristics of the corrugator fabric.

Figure 4A:
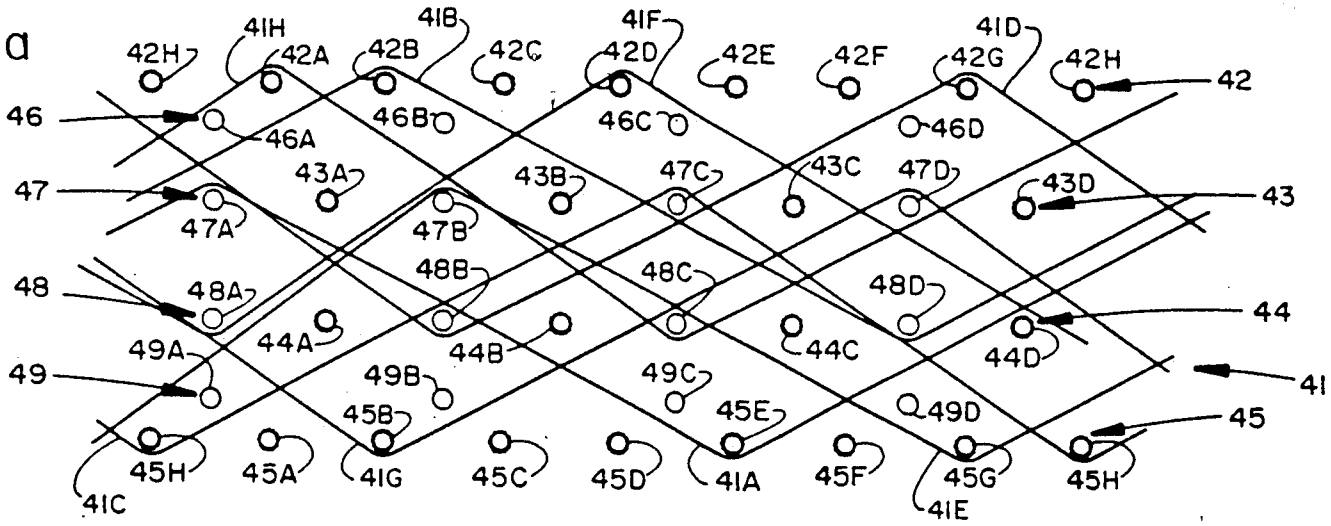
FIGS. 4*a–b* are schematic diagrams of the weave structure of a first alternate embodiment of a corrugator belt made in accordance with the teachings of the present invention.
Figure 4B:
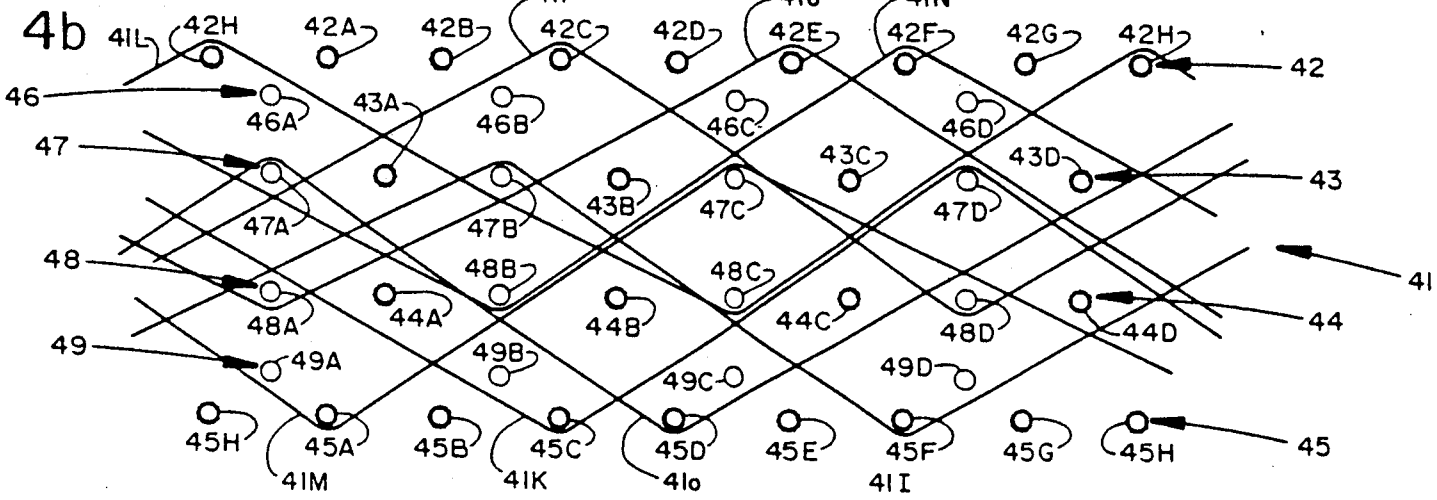
Figure 5A:
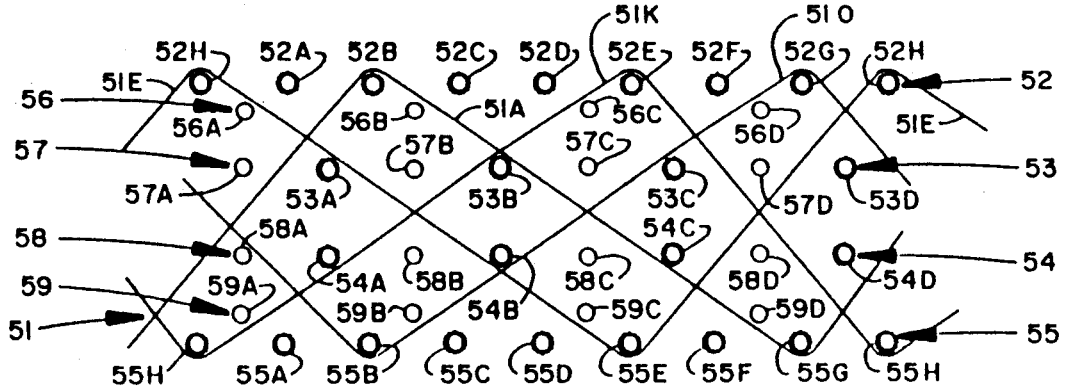
FIGS. 5*a–d* are schematic diagrams of the weave structure of a second alternate embodiment of a corrugator belt made in accordance with the teachings of the present invention.
Figure 5B:
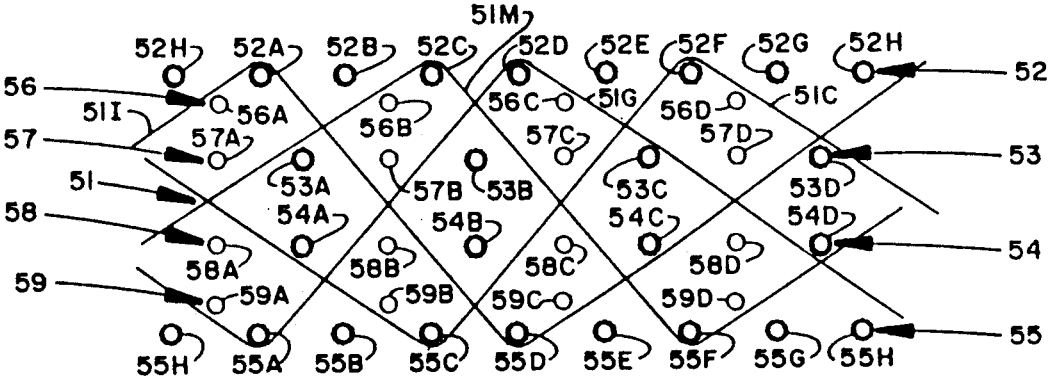
Figure 5C:
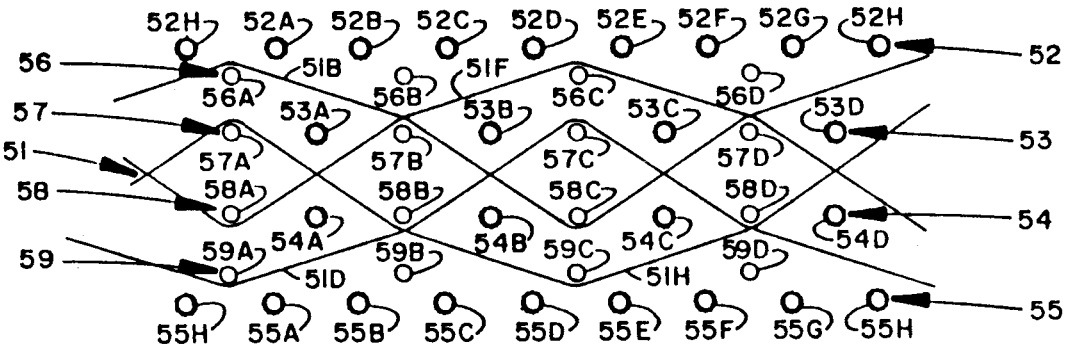
Figure 5D:
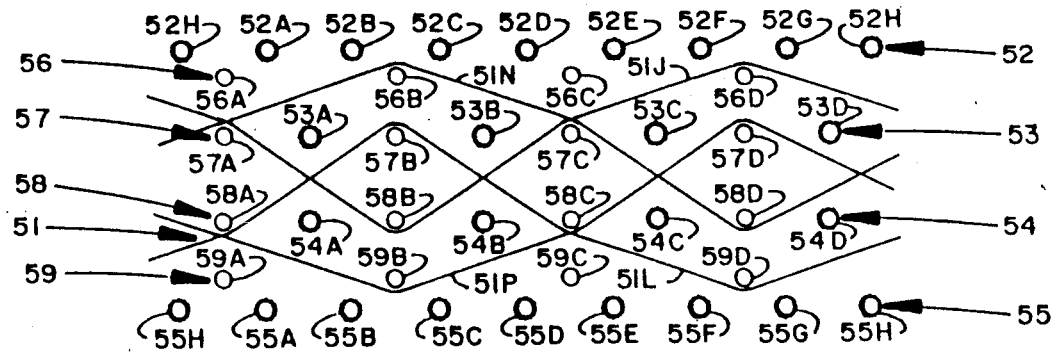

With reference to FIGS. 4*a–b*, there is shown a 16-harness monofilament warp system 41 which selectively interweaves in a repeat pattern with four layers of bulky yarns 42, 43, 44, 45 and four layers of monofilament yarns 46, 47, 48, 49.

As with the preferred embodiment, half of the monofilament warp yarns of the fabric shown in FIGS. 4*a–b*, interweave with the top bulky yarn filling layer 42 and three of the monofilament filling layers 46, 47, 48 and the other half of the warp yarns weave with the bottom bulky yarn filling layer 45 and three of the monofilament filling layers 47, 48, 49.

As shown in FIGS. 4*a–b*, the system 41 of warp yarns is a 16-harness warp system. Yarns of warp system 41 are labelled 41*a–p* to indicate the sequence of weaving of the warp yarn harness. Preferably these yarns are polyester monofilament yarns having a diameter of 0.20 inches. Top and bottom filling yarn layers 42, 45 each contain eight yarns in their repeat labelled 42*a–h*, 45*a–h* respectively; the intermediate layers of filling yarns 43, 44, 46, 47, 48, 49, each contain four yarns in their repeat which are labelled 43*a–d*, 44*a–d*, 46*a–d*, 47*a–d*, 48*a–d*, 49*a–d*, respectively.

Warp yarns 41*a*, 41*c*, 41*e*, 41*g*, 41*i*, 41*k*, 41*m*, 41*o*, each interweave under a separate bulky yarn in the repeat of bottom layer 45 and with the interior layers of the fabric. For example, yarn 41*a* weaves over yarn 47*a*, between yarns 42*a* and 45*a*, between yarns 43*a* and 44*a*, between yarns 42*b* and 45*b*, between yarns 47*b* and 48*b*, between yarns 42*c* and 45*c*, under yarn 44*b*, between yarns 42*d* and 45*d*, under yarn 49*c*, under yarn 45*e*, under yarn 44*c*, between yarns 42*f* and 45*f*, between yarns 48*d* and 49*d*, between yarns 42*g* and 45*g*, between yarns 43*d* and 44*d*, and between yarns 42*h* and 45*h* whereafter the pattern is repeated. In a similar fashion warp yarn 41*c* interweaves with bottom layer yarn 45*h*; warp yarn 41*e* interweaves with bottom layer yarn 45*g*, and warp yarn 41*g* interweaves with bottom layer yarn 45*b*.

Warp yarns 41*i* interweaves with bottom layer 45*f*, warp yarn 41*k* interweaves with bottom layer yarn 45*c*, warp yarn 41*m* interweaves with bottom layer yarn 45*a*, and warp yarn 41*o* interweaves with bottom layer yarn 45*d* in a similar but slightly different manner. For example, warp yarn 41*o* weaves over yarn 47*a* between yarns 42*a* and 45*a*, between yarns 43*a* and 44*a*, between yarns 42*b* and 45*b*, between yarns 48*b* and 49*b*, between yarns 42*c* and 45*c*, under yarn 44*b*, under yarn 45*d*, under yarn 49*c*, between yarns 42*e* and 45*e*, under yarn 44*c*, between yarns 42*f* and 45*f*, between yarns 47*d* and 48*d*, between yarns 42*g* and 45*g*, between yarns 43*d* and 44*d*, between yarns 42*h* and 45*h* and thereafter repeats.

Warp yarns 41*b*, 41*d*, 41*f*, 41*h*, 41*j*, 41*l*, 41*n*, and 41*p* interweave over top layer bulky yarns 42*b*, 42*g*, 42*d*, 42*a*, 42*e*, 42*h*, 42*f*, and 42*c*, respectively, in a mirror image of the warp yarns which weave under the bottom layer 45 of bulky filling yarns as described above.

Where four layers of monofilament filling yarns are desired, the interweaving system of monofilament warp yarns may include selected warp yarns which interweave only with intermediate filling yarn layers. Such weaves provides additional structural integrity to enhance the stability of the fabric.

With reference to FIGS. 5*a–d*, there is shown a 16-harness monofilament warp system 51 which selectively interweaves in a repeat pattern with four layers of bulky yarns 52, 53, 54, 55 and four layers of monofilament yarns 56, 57, 58, 59. In this embodiment half of the warp yarns interweave entirely in the interior fabric.

As shown in FIGS. 5*a–d*, the system 51 of warp yarns is a 16-harness warp system. Yarns of warp system 51 are labelled 51*a–p* to indicate the sequence of weaving of the warp yarn harness. Preferably these yarns are polyester monofilament yarns having a diameter of 0.20 inches. Top and bottom filling yarn layers 52, 55 each contain eight yarns in their repeat labelled 52*a–h*, 55*a–h* respectively; the intermediate layers of filling yarns 53, 54, 56, 57, 58, 59, each contain four yarns in their repeat which are labelled 53*a–d*, 54*a–d*, 56*a–d*, 57*a–d*, 58*a–d*, 59*a–d*, respectively.

Warp yarns 51*a*, 51*c*, 51*e*, 51*g*, 51*i*, 51*k*, 51*m*, 51*o*, each interweave over a separate bulky yarn in the repeat of top layer 52 and under a separate bulky yarn in the repeat of bottom layer 55. For example, yarn 51*a* weaves between yarn 57*a* and 58*a*, between yarns 52*a* and 55*a*, over yarn 53*a*, over yarn 52*b*, over yarn 56*b*, between yarns 52*c* and 55*c*, over yarn 53*b*, between yarns 52*d* and 55*d*, between yarns 57*c* and 58*c*, between yarns 52*e* and 55*e*, under yarn 54*c*, between yarns 52*f* and 55*f*, under yarn 59*d*, under yarn 55*g*, under yarn 54*d*, and between yarns 52*h* and 55*h* whereafter the pattern is repeated. In a similar fashion warp yarn 51*c* interweaves with top and bottom layer yarns 52*f* and 55*c*; warp yarn 51*e* interweaves with top and bottom layer yarns 52*h* and 55*e*; warp yarn 51*g* interweaves with top and bottom layer yarns 52*d* and 55*a*; warp yarn 51*i* interweaves with top and bottom layers yarns 52*a* and 55*d*, warp yarn 51*k* interweaves with top and bottom layer yarns 52*e* and 55*h*, warp yarn 51*m* interweaves with top and bottom layer yarns 52*c* and 55*f*, and warp yarn 51*o* interweaves with top and bottom layer yarns 52*g* and 55*b*.

Warp yarns 51*b*, 51*d*, 51*f*, 51*h*, 51*j*, 51*l*, 51*n*, and 51*p* interweave entirely with the intermediate filling layers 53, 54, 56, 57, 58 and 59. For example, warp yarn 51*b* weaves over yarn 56*a*, between yarns 52*a* and 55*a*, over yarn 53*a*, between yarns 52*b* and 55*b*, between yarns 56*b* and 57*b*, between yarns 52*c* and 55*c*, between yarns 53*b* and 54*b*, between yarns 52*d* and 55*d*, between yarns 58*c* and 59*c*, between yarns 52*e* and 55*e*, between yarns 53*c* and 54*c*, between yarns 52*f* and 55*f*, between yarns 56*d* and 57*d*, between yarns 52*g* and 55*g*, over yarn 53*d*, between yarns 52*h* and 55*h* and thereafter repeats.

Figure 6A:
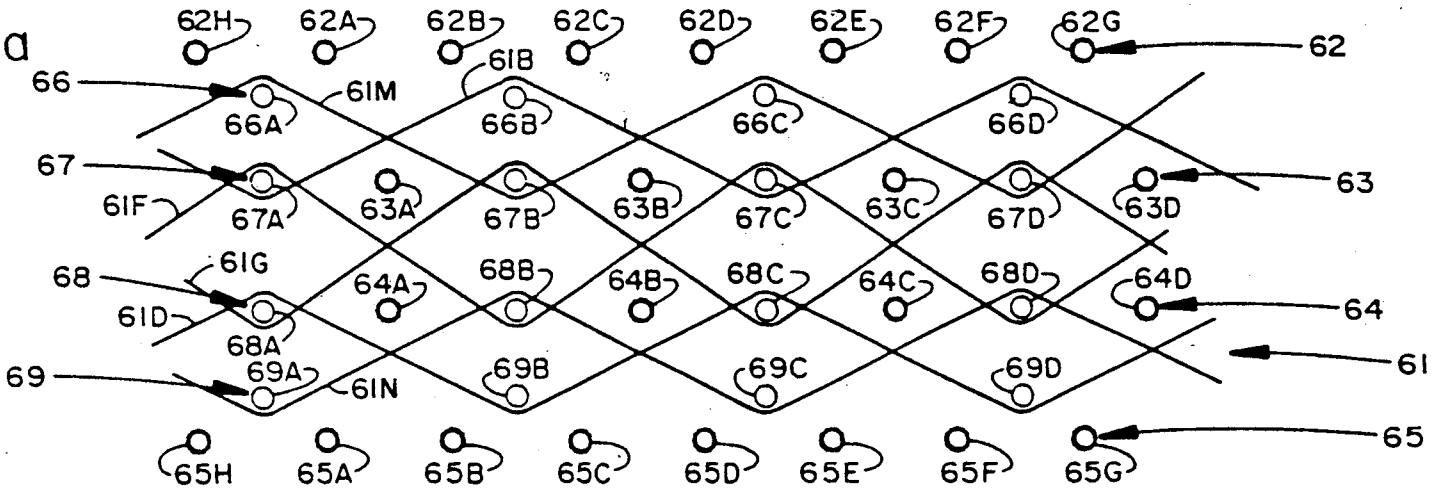
FIGS. 6*a–b* are schematic diagrams of the weave structure of a third alternate embodiment of a corrugator belt made in accordance with the teachings of the present invention.
Figure 6B:
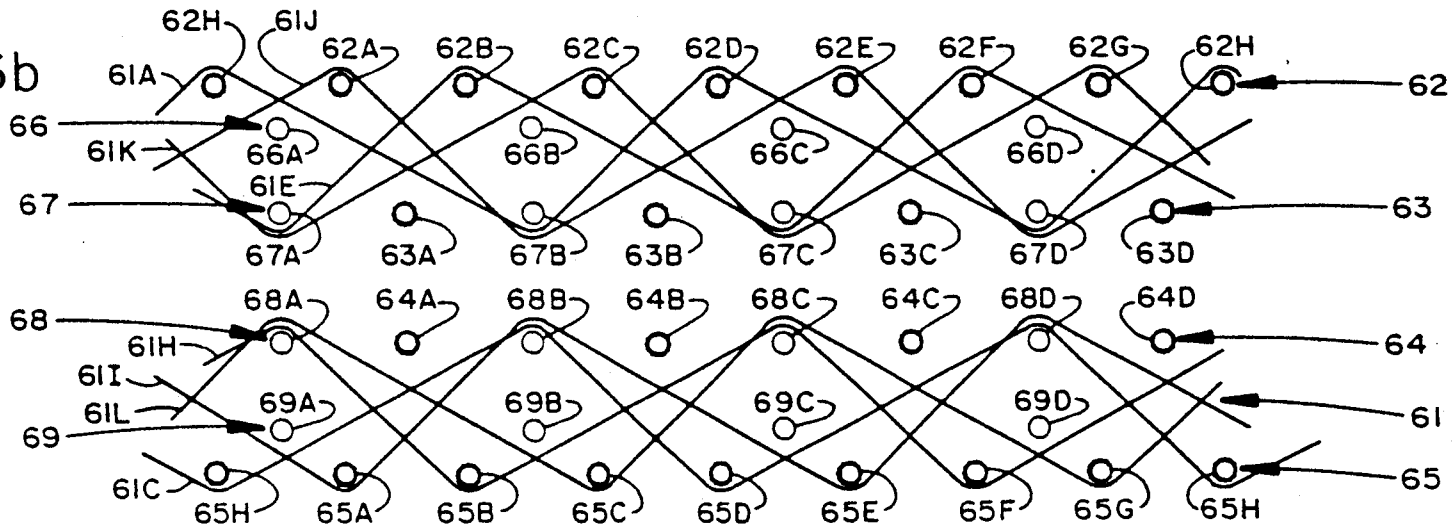

With reference to FIGS. 6*a–b*, there is shown a 14-harness monofilament warp system 61 which selectively interweaves in a repeat pattern with four layers of bulky yarns 62, 63, 64, 65 and four layers of monofilament yarns 66, 67, 68, 69. In this embodiment, six of the fourteen yarns interweave entirely in the interior fabric.

As shown in FIGS. 6*a–b*, the system 61 of warp yarns is a 14-harness warp system. Yarns of warp system 61 are labelled 61*a–n* to indicate the sequence of weaving of the warp yarn harness. Preferably these yarns are polyester monofilament yarns having a diameter of 0.20 inches. Top and bottom filling yarn layers 62, 65 each contain eight yarns in their repeat labelled 62*a–h*, 65*a–h* respectively; the intermediate layers of filling yarns 63, 64, 66, 67, 68, 69, each contain four yarns in their repeat which are labelled 63*a–d*, 64*a–d*, 66*a–d*, 67*a–d*, 68*a–d*, 69*a–d*, respectively.

Warp yarns 61*a*, 61*e*, 61*j*, 61*k*, each interweave over two separate bulky yarns in the repeat of top layer 62 and with two of the interior monofilament 66, 67 layers of the fabric. For example, yarn 61*a* weaves over yarn 66*a*, between yarns 62*a* and 65*a*, over yarn 63*a*, between yarns 62*b* and 65*b*, between yarns 67*b* and 68*b*, between yarns 62*c* and 65*c*, over yarn 63*b*, over yarn 62*d*, over yarn 66*c*, between yarns 62*e* and 65*e*, over yarn 63*c*, between yarns 62*f* and 65*f*, between yarns 67*d* and 68*d*, between yarns 62*g* and 65*g*, over yarn 63*d*, and over yarn 62*h* whereafter the pattern is repeated. In a similar fashion warp yarn 61*e* interweaves with top layer yarns 62*b* and 62*f*.

Warp yarns 61*j* interweaves with top layer yarns 62*a* and 62*e*, and warp yarn 61*k* interweaves with top layer yarns 62*c* and 62*g*, in a similar but slightly different manner. For example, warp yarn 61*j* weaves over yarn 66*a*, over yarn 62*a*, over yarn 63*a*, between yarns 62*b* and 65*b*, between yarns 67*b* and 68*b*, between yarns 62*c* and 65*c*, over yarn 63*b*, between yarns 62*d* and 65*d*, over yarn 66*c*, over yarn 62*e*, over yarn 63*c*, between yarns 62*f* and 65*f*, between yarns 67*d* and 68*d*, between yarns 62*g* and 65*g*, over yarn 63*d*, between yarns 62*h* and 65*h* and thereafter repeats.

Warp yarns 61*c*, 61*h*, 61*i*, 61*l* interweave under bottom layer bulky yarn pairs 65*d* and 65*h*, 65*b* and 65*f*, 65*a* and 65*e*, 65*c* and 65*g*, respectively, in a mirror image of the warp yarns which weave over the top layer 62 of bulky filling yarns as described above.

Warp yarns 61*b*, 61*d*, 61*f*, 61*g*, 61*m*, and 61*n* interweave entirely with the intermediate filling layers, each interweaving with two of the monofilament layers 66, 67, 68 and 69. For example, warp yarn 61*b* weaves between yarns 67*a* and 68*a*, between yarns 62*a* and 65*a*, over yarn 63*a*, between yarns 62*b* and 65*b*, over yarn 66*b*, between yarns 62*c* and 65*c*, over yarn 63*b*, between yarns 62*d* and 65*d*, between yarns 67*c* and 68*c*, between yarns 62*e* and 65*e*, over yarn 63*c*, between yarns 62*f* and 65*f*, over yarn 66*d*, between yarns 62*g* and 65*g*, over yarn 63*d*, between yarns 62*h* and 65*h* and thereafter repeats. Yarn 61*m* weaves in a mirror image with monofilament layers 66 and 67 between bulky filling yarn layers 62 and 63. Similarly, yarns 61*f* and 61*g* interweave with monofilament layers 67 and 68 between bulky filling yarn layers 63 and 64 and yarns 61*d* and 61*n* interweave with monofilament layers 68 and 69 between bulky filling yarn layers 64 and 65.

These latter two weave structures, FIGS. 5*a–d* and 6*a–b*, additionally help to maintain the stability and the caliper of the overall fabric by maintaining the relative vertical alignment and spacing of the yarns of the monofilament filling layers. Although several specific warp harness weaves are disclosed, other configurations of monofilament warp systems could be used to interweave the multiple layers of filling yarns.

What I claim is:

1. A corrugator apparatus for manufacturing corrugated paper products, the apparatus having a series of heat element means spaced from and associated with pressure application means to facilitate the processing of the corrugated paper product, and a papermakers fabric which traverses between said heat element means and said pressure application means to transport the paper product across the heat element means, wherein the papermakers fabric comprises a system of monofilament warp yarns interwoven with at least four layers of bulky filling yarns and first, second and third intermediate layers of monofilament filling yarns in a repeat pattern such that at least two of said bulky yarn layers and at least said third monofilament filling layer are disposed between said first and second intermediate monofilament yarn layers.

2. An apparatus according to claim 1 wherein said third monofilament filling yarn layer is disposed between two of said bulky yarn layers which are disposed between said first and second intermediate monofilament layers.

3. An apparatus according to claim 1 wherein one of said bulky yarn layers comprises a top fabric layer and another of said bulky layers comprises a bottom fabric layer, wherein said monofilament warp yarns which interweave with said top layer interweave with at least three of said monofilament filling yarn layers and wherein said monofilament warp yarns which interweave with said bottom layer interweave with at least three of said monofilament filling yarn layers.

4. An apparatus according to claim 3 wherein said monofilament warp yarns comprise a 16-harness system and half of said monofilament warp yarns interweave with said top filling layer and the other half of said monofilament warp yarns interweave with said bottom filling layer.

5. An apparatus according to claim 1 wherein said fabric further comprises a fourth intermediate layer of monofilament filling yarns disposed between said first and second monofilament yarn layers.

6. An apparatus according to claim 5 wherein one of said bulky yarn layers comprises a top fabric layer and another of said bulky yarn layers comprises a bottom fabric layer, wherein said monofilament warp yarns which interweave with said top layer interweave with at least two of said monofilament filling layers, and wherein said monofilament warp yarns which interweave with said bottom layer interweave with at least two of said monofilament layers.

7. An apparatus according to claim 6 wherein at least four of said monofilament warp yarns do not interweave with either said top or bottom fabric layers.

8. An apparatus according to claim 5 wherein said third monofilament filling layer is substantially coplanar with one of said intermediate bulky yarn layers and said fourth monofilament filling layer is substantially coplanar with another of said intermediate bulky yarn layers.

9. An apparatus according to claim 1 wherein said fabric has a substantially uniform caliper of at least 0.2 inches, a substantially uniform permeability of at least 25 CFM and a substantially uniform weight of less than 15 ounces per square foot.

10. An apparatus according to claim 9 wherein said bulky yarns are polyester spun yarns weighing about 400 yards per pound.

11. An apparatus according to claim 9 wherein said bulky yarns are spun yarns made from fibers of at least 15 denier.

12. An apparatus according to claim 9 wherein said fabric caliper is approximately 0.21 inches, said fabric permeability is approximately 27 CFM, and said fabric weight is approximately 12 ounces per square foot.

13. A corrugator belt comprising a woven fabric having a system of monofilament warp yarns interwoven with at least four layers of bulky filling yarns and first, second and third intermediate layers of monofilament filling yarns in a repeat pattern such that at least two of said bulky yarn layers and at least said third monofilament filling layer are disposed between said first and second intermediate monofilament yarn layers.

14. A corrugator belt according to claim 13 wherein said third monofilament filling yarn layer is disposed between two of said bulky yarn layers which are disposed between said first and second intermediate monofilament layers.

15. A corrugator belt according to claim 13 wherein one of said bulky yarn layers comprises a top fabric layer and another of said bulky layers comprises a bottom fabric layer, wherein said monofilament warp yarns which interweave with said top layer interweave with at least three of said monofilament filling yarn layers and wherein said monofilament warp yarns which interweave with said bottom layer interweave with at least three of said monofilament filling yarn layers.

16. A corrugator belt according to claim 15 wherein said monofilament warp yarns comprise a 16-harness system and half of said monofilament warp yarns interweave with said top filling layer and the other half of said monofilament warp yarns interweave with said bottom filling layer.

17. A corrugator belt according to claim 13 wherein said fabric further comprises a fourth intermediate layer of monofilament filling yarns disposed between said first and second monofilament yarn layers.

18. A corrugator belt according to claim 17 wherein one of said bulky yarn layers comprises a top fabric layer and another of said bulky yarn layers comprises a bottom fabric layer, wherein said monofilament warp yarns which interweave with said top layer interweave with at least two of said monofilament filling layers, and wherein said monofilament warp yarns which interweave with said bottom layer interweave with at least two of said monofilament layers.

19. A corrugator belt according to claim 18 wherein at least four of said monofilament warp yarns do not interweave with either said top or bottom fabric layers.

20. A corrugator belt according to claim 19 wherein said third monofilament filling layer is substantially coplanar with one of said intermediate bulky yarn layers and said fourth monofilament filling layer is substantially coplanar with another of said intermediate bulky yarn layers.

21. A corrugator belt according to claim 13 wherein said fabric has a substantially uniform caliper of at least 0.2 inches, a substantially uniform permeability of at least 25 CFM and a substantially uniform weight of less than 15 ounces per square foot.

22. A corrugator belt according to claim 21 wherein said bulky yarns are polyester spun yarns weighing about 400 yards per pound.

23. A corrugator belt according to claim 21 wherein said bulky yarns are spun yarns made from fibers of at least 15 denier.

24. A corrugator belt according to claim 21 wherein said fabric caliper is approximately 0.21 inches, said fabric permeability is approximately 27 CFM, and said fabric weight is approximately 12 ounces per square foot.

* * * * *

UNITED STATES PATENT AND TRADEMARK OFFICE

CERTIFICATE OF CORRECTION

PATENT NO. : 5,050,646

DATED : September 24, 1991

INVENTOR(S) : Ted Fry

It is certified that error appears in the above-identified patent and that said Letters Patent is hereby corrected as shown below:

At column 2, line 18, before the word 'weight' insert --a--.

At column 2, line 49, delete the word "Which" and insert therefor --which--.

At column 4, line 47, delete the word "weighted" and insert therefor --weighed--.

At column 4, line 52, delete "a-b" and insert therefor --3a-b--.

IN THE CLAIMS

In claim 20, column 10, line 7, delete "19" and insert therefor --17--.

Signed and Sealed this

Ninth Day of February, 1993

*Attest:*

STEPHEN G. KUNIN

*Attesting Officer*

*Acting Commissioner of Patents and Trademarks*